US006277243B1

(12) United States Patent
Binder et al.

(10) Patent No.: US 6,277,243 B1
(45) Date of Patent: Aug. 21, 2001

(54) METHOD FOR MIXING AND RECIRCULATING STOCK SUSPENSIONS AND WATER FLOWS IN THE WET END OF A PAPER MACHINE

(75) Inventors: Erwin Binder; Karl-Heinz Beuermann, both of Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/345,776

(22) Filed: Jul. 1, 1999

(30) Foreign Application Priority Data

Jul. 9, 1998 (DE) ..... 198 30 600

(51) Int. Cl.[7] ..... D21F 1/66; D21H 11/14

(52) U.S. Cl. ..... 162/189; 162/190; 162/191; 162/264

(58) Field of Search ..... 162/190, 264, 162/189, 191

(56) References Cited

U.S. PATENT DOCUMENTS

| | | | |
|---|---|---|---|
| 3,966,540 | 6/1976 | Selander et al. | 162/190 |
| 4,477,313 | 10/1984 | Andersson | 162/123 |
| 5,958,189 | 9/1999 | Begemann et al. | 162/264 |

FOREIGN PATENT DOCUMENTS

| | | |
|---|---|---|
| 653395 | 12/1985 | (CH) . |
| 4000558 | 7/1990 | (DE) . |
| 19509522 | 9/1996 | (DE) . |
| 2641803 | 7/1990 | (FR) . |
| 1482002 | 8/1977 | (GB) . |

*Primary Examiner*—Dean T. Nguyen
(74) *Attorney, Agent, or Firm*—Greenblum & Bernstein, P.L.C.

(57) ABSTRACT

Mixing and recirculation cycling system and method, for use in the stable section of a paper or cardboard machine. The system includes a dilution water-regulated headbox, a backwater tank having a backwater inlet and at least one stock suspension inlet adapted to provide for the mixing of stock suspensions with the backwater. Also provided is a mixing tank operatively connected to the backwater tank, at least one backwater inlet operatively connected between the backwater tank and the headbox, and a pressure-increasing device operatively connected between the mixing tank and the backwater tank. The method includes feeding backwater from the wet section into a backwater tank, feeding the return flow into a mixing tank, mixing the return flow in the mixing tank, injecting the return flow from the mixing tank into a lower region of the backwater tank via a pressure increasing device, mixing the return flow with the backwater and added fresh stock, and feeding the return flow to the headbox via a separation device.

8 Claims, 4 Drawing Sheets

METHOD FOR MIXING AND RECIRCULATING STOCK SUSPENSIONS AND WATER FLOWS IN THE WET END OF A PAPER MACHINE

CROSS-REFERENCE TO RELATED APPLICATIONS

The present application claims priority under 35 U.S C. §119 of German Patent Application No. 198 30 600.8, filed on Jul. 9, 1998, the disclosure of which is expressly incorporated by reference herein in its entirety.

BACKGROUND OF THE INVENTION

1. Field of the Invention

The invention relates to a mixing and recirculation cycling system in the stable section of a paper or cardboard machine and to a method for the mixing and recirculation of stock suspensions, backwater, and return flows in a paper or cardboard machine, and particularly in the stable section.

2. Description of Background Information

A mixing and recirculation cycling system for stick suspensions is known from U.S. Pat. No. 4,477,313 which issued to Anderson on Oct. 16, 1984. According to this patent, the backwater collected in the paper machine is passed into open backwater tanks and, after being provided with thick stock in mixing pumps, fed again to the headbox.

A similar device and a similar method are known from German published Application No. DE 195 09 522 A1. In this invention, a headbox sectioned over the machine width is fed with a stock suspension through a large number of stock suspension feed lines from a distributor. Part of the backwater appearing in the drainage section of the paper machine is sectionally returned to the headbox and is used for weight basis control according to the dilution principle.

In paper and cardboard machines with known embodiments of the stable section, degrees of temporal basis weight fluctuation and paper composition fluctuation appear that are no longer acceptable, due to increasing machine speeds as well as simultaneously rising quality specifications for paper.

In order to show the operating environment of the invention, a customary related art mixing and recirculation cycling system in a stable section of paper and cardboard machines is depicted by way of example in FIG. 1. However, the invention also operates with differently implemented cycling systems, and differently designed cycling systems do not depart from the framework of the invention.

FIG. 1 is a schematic illustration of a wet section 24 of a paper or cardboard machinery with a dilution water-regulated headbox (i.e., the headbox is regulated by dilution water). Backwater is taken from the wet section and fed via a backwater inlet 3 into a backwater tank 1. Headbox recirculation 4 from a headbox 23, deculator overflow 22 from a deculator 29, and accepted stock from a second vertical separator stage 26 also flow into the backwater tank 1. First and second cleaner stages 27 and 28 feed the deculator 29, which in turn feeds the backwater tank 1 and a first vertical separator stage 25. A first portion of the backwater is passed from the backwater tank 1 to the headbox 23 via a separation device, which is a vertical separator 30 in this case. Most of the backwater mixes with the fresh stock. The excess backwater from the cycle of the stable section may escape from the cycling system via a backwater discharge line 31.

FIG. 2 depicts a known backwater tank 1, into which the backwater inlet 3 is introduced. Simultaneously, the headbox recirculation 4, the accepted stock from the second vertical separator stage 5, the accepted stock from the second cleaner stage, and possibly the deculator overflow 6 are introduced into the upper region of the backwater tank 1. Fresh stock is fed into the lower region of the backwater tank via line 8.

Discharge lines 9 for the dilution water for the vertical separator and the cleaner system, then the backwater inlet 10 to the headbox for dilution water regulation and, in the lowest region and the stock suspension inlet 11 to the first cleaner stage or to the deculator, are disposed from top to the bottom of the discharging lines from the backwater tank, as seen in FIG. 2.

In this type of design, extreme stock density fluctuations in the backwater tank occur due to temporally unstable currents of the backflows. For example, the headbox recirculation of the accepted stock of the vertical separator stage, or of the accepted stock of the second cleaner stage has these problematic fluctuations. The blending of the return flows in the usually large backwater tank also results in the disadvantage that, at the time of a change in the type of paper, it takes a long time before temporally stable relationships in volume flow and stock density are reestablished.

Another known design of the mixing and recirculation cycling system in the stable section of a paper machine is depicted in FIG. 3. The backwater feed 3 flows into the open top of the tank, and a mixing tube 2 is introduced in the bottom region of the tank. The headbox recirculation 4, the accepted stock of the second vertical separator stage 5, and the accepted stock of the second cleaner stage 6 and possibly also the deculator overflow run into the mixing tube 2. A feed line 8 for the addition of fresh stock, which is also introduced in the lower region of the backwater tank, is concentrically provided in the mixing tube 2. The addition of fresh stock may be adjusted by a control valve 12 and a flowmeter 13. Through the concentric arrangement of the fresh stock feed 8 in the mixing tube 2, thorough mixing of the fresh stock with the remaining suspension added and with the backwater is achieved. At the upper region of the backwater tank 1, the backwater inlet 10 is connected to the headbox, and at the bottom region near the fresh stock feed, the stock suspension is pumped from the backwater tank via the stock suspension inlet 1 to the first cleaner stage or to the deculator with the help of a pump 12.

While this design of stock piping avoids the introduction of the return flows directly into the backwater tank, a significant disadvantage of this design is that the flow rate at the outlet of the mixing tube 2 is too low for thorough mixing, since the difference in fluid levels $\Delta h_{geo}$ of the mixing tube and the tank 1 is excessively low. Thus, only slight flow rate differences can be generated in the region of the mixing point.

SUMMARY OF THE INVENTION

The invention provides a mixing and recirculation cycling system and method for the stable section of a paper or cardboard machine, as well as an improved method for the mixing and recirculation of stock suspensions, backwater, and return flows in a paper or cardboard machine, in particular in the stable section, which minimize the temporal fluctuations of the characteristics of the paper.

In order to minimize the temporal fluctuations of the characteristics of the paper, it is necessary to improve the mixing of the various suspensions with differing concentrations. In the return flows, such as accepted stocks of the second cleaner stage and of die second vertical separator stage and the headbox recirculation, are mixed in a separate mixing tank (i.e., the mixing tank being separate from the backwater tank) and fed with a device that increases pressure into the backwater tank for further mixing with fresh stock, backwater, and possibly deculator overflow. Preferably, tie pressure increase and the transfer from the mixing tank to the backwater tank both occur with the help of a pump.

According to another aspect of the concept of the invention, the mixing tank has a first chamber with a plurality of feed lines connected thereto, and a second chamber having at least one discharge line, whereby the discharge line leads to the backwater tank and an overflow is provided between the first and the second chambers.

In still another aspect of the mixing and recirculation cycling system, a control loop to regulate the liquid level in die mixing tank is provided. In this control loop, the fill of the mixing tank is determined by a level transmitter. Should the level of the mixing tank deviate from a desired value, a valve may be actuated, such as a control element. Volume flow taken from the mixing tank can be controlled by the control element such that the mixing tank fill corresponds to the desired fill. Instead of the control valve, a pump can also have its speed regulated by a speed regulator.

A particularly advantageous feature of the mixing and recirculation cycling system provides two concentric feed pipes, which respectively supply fresh stock and return flow into the backwater tank. This arrangement results in thorough mixing of the fresh stock with the return flow and the backwater.

Moreover, if a deculator is used, the mixing and recirculation cycling system can also employ an additional third feed pipe is provided to supply deculator overflow, the third pipe being concentric to the feed pipes for fresh stock and return flow. Preferably, the order of pipes form the inside to the outside is fresh stock feed, return flow, and deculator overflow. This order corresponds to the order in which the volume flows are added. However, with limited mixing results, different orders may also be selected.

According to the method for the mixing and recirculation of stock suspensions, backwater, and return flows in a paper or cardboard machine, particularly in the stable section, having at least a headbox, a backwater tank, a vertical separator stage, a cleaner stage, and possibly a deculator, may include talking backwater from the wet section and fed into a backwater tank, and feeding the return flow, which includes at least the recirculation of the headbox, the accepted stock of at least one vertical separator stage, and the accepted stock of at least one cleaner stage, into a mixing tank. The method may further include mixing the return flow in the mixing tank, and injecting the return flow into the lower region of the backwater tank with the help of a pressure increasing device (for example, a pump) The return flow may then be mixed with the backwater and added fresh stock, and conveyed to the headbox via a separation device, for example, a cleaner stage and/or a deculator and/or a vertical separator.

According to one feature of the method, the return flow may be initially mixed in a first chamber of the mixing tank, then passed by an overflow into a second chamber of the mixing tank, and then conveyed to the backwater tank.

It is also advantageous for uniform thorough mixing if the return flow and the fresh stock addition into the backwater tank occur concentrically in two pipes or, if a deculator is present in the lower region of the backwater tank, the deculator overflow is fed in as well.

The deculator overflow, the return flow, and the fresh stock may also occur concentrically in three feed pipes. With this type of feeding of the deculator overflow, return flow, and fresh stock, uniform thorough mixing of the suspension is obtained. Since the deculator overflow usually represents the largest volume flow, it is advantageous to supply this in the outermost of the concentric pipes. Based on volumetric flow, the entire return flow then follows in the middle feed pipe, and the fresh stock flows through in the innermost feed pipe.

Of course, the aforementioned characteristics of the invention and those yet to be explained in the following can be applied not only in the combination reported, but also in other combinations or in isolation, without departing from the framework of the invention.

The present invention provides a mixing and recirculation cycling system and method. The system of the present invention includes a dilution water-regulated headbox, a backwater tank having a backwater inlet and at least one stock suspension inlet adapted to provide for the mixing of stock suspensions with the backwater. Also provided is a mixing tank operatively connected to the backwater tank, at least one backwater inlet operatively connected between the backwater tank and the headbox, and a pressure-increasing device operatively connected between the mixing tank and the backwater tank.

The mixing tank may include a first chamber having a plurality of feed lines connected thereto, and a second chamber having at least one discharge line which leads to the backwater tank, and an overflow intermediate the first chamber and the second chamber. The pressure-increasing device may be a feed pump. A control valve operatively connected between the mixing tank and the backwater tank may also be included. Additionally, a control loop adapted to control the liquid level in the mixing tank may be provided.

A concentrically-arranged feed pipe adapted to feed the backwater tank with fresh stock through a first feed pipe of the concentrically-arranged feed pipe, and further adapted to feed the backwater tank with return flow through a second feed pipe of the concentrically-arranged feed pipe, may be provided. A predetermined longitudinal distance between the respective distal portions of the first feed pipe and the second feed pipe may exist, and the distal portion of the first feed pipe may extend beyond the distal portion of the second feed pipe by this predetermined distance.

A third feed pipe arranged concentrically about the first and the second feed pipes may further be provided. This third feed pipe is adapted to feed the backwater tank with deculator overflow. Additionally, the first feed pipe, the second feed pipe and the third feed pipe each have a distal portion, and a predetermined longitudinal distance between at least two of the respective distal portions of the first, second and third feed pipes is provided. Also, the distal portion of the first feed pipe may extend beyond the distal portion of the second feed pipe by the predetermined distance, and the distal position of the second feed pipe may extend beyond the third feed pipe by a second predetermined distance.

The invention may further include a mixing element provided in the mixing tank, preferably, a mixing propeller.

Also, the system may be adapted for use in a stable section of one of a paper and cardboard machine.

The method of the invention includes feeding backwater from the wet section into a backwater tank, feeding the return flow into a mixing tank, the return flow comprising at least one of recirculation of the headbox, accepted stock of at least one vertical separator stage, and accepted stock of least one cleaner stage. The method of the invention also includes mixing the return flow in the mixing tank, injecting the return flow from the mixing tank into a lower region of the backwater tank via a pressure increasing device, mixing the return flow with the backwater and added fresh stock, and feeding the return flow to the headbox via a separation device. The separation device may be a cleaner stage, a deculator and/or a vertical separator.

The method may further include mixing the return flow in a first chamber of the mixing tank, passing the return flow into a second chamber by an overflow, and conveying the return flow into a backwater tank.

Additionally, the injection of the return flow from the mixing tank into a lower region of the backwater tank may be facilitated by a pump. The return flow may be controlled according to the liquid level in the mixing tank.

The method may further include feeding, through a concentrically-arranged feed pipe, the fresh stock and the return flow into the backwater tank, the fresh stock being fed through a first feed pipe of the con centrically-arranged feed pipe, and the return flow being fed through a second feed pipe of the concentrically-arranged feed pipe.

Also, the method may further include feeding deculator overflow into the lower region of the backwater tank. The feeding of deculator overflow into the backwater tank may occur, along with the fresh stock and the return flow, though a concentrically-ranged feed pipe, the fresh stock being fed through a first feed pipe of the concentrically-arranged feed pipe, the return flow being fed through a second feed pipe of the concentrically-arranged feed pipe, and the deculator overflow being, fed through a third feed pipe of the concentrically-arranged feed pipe.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful an readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 4:
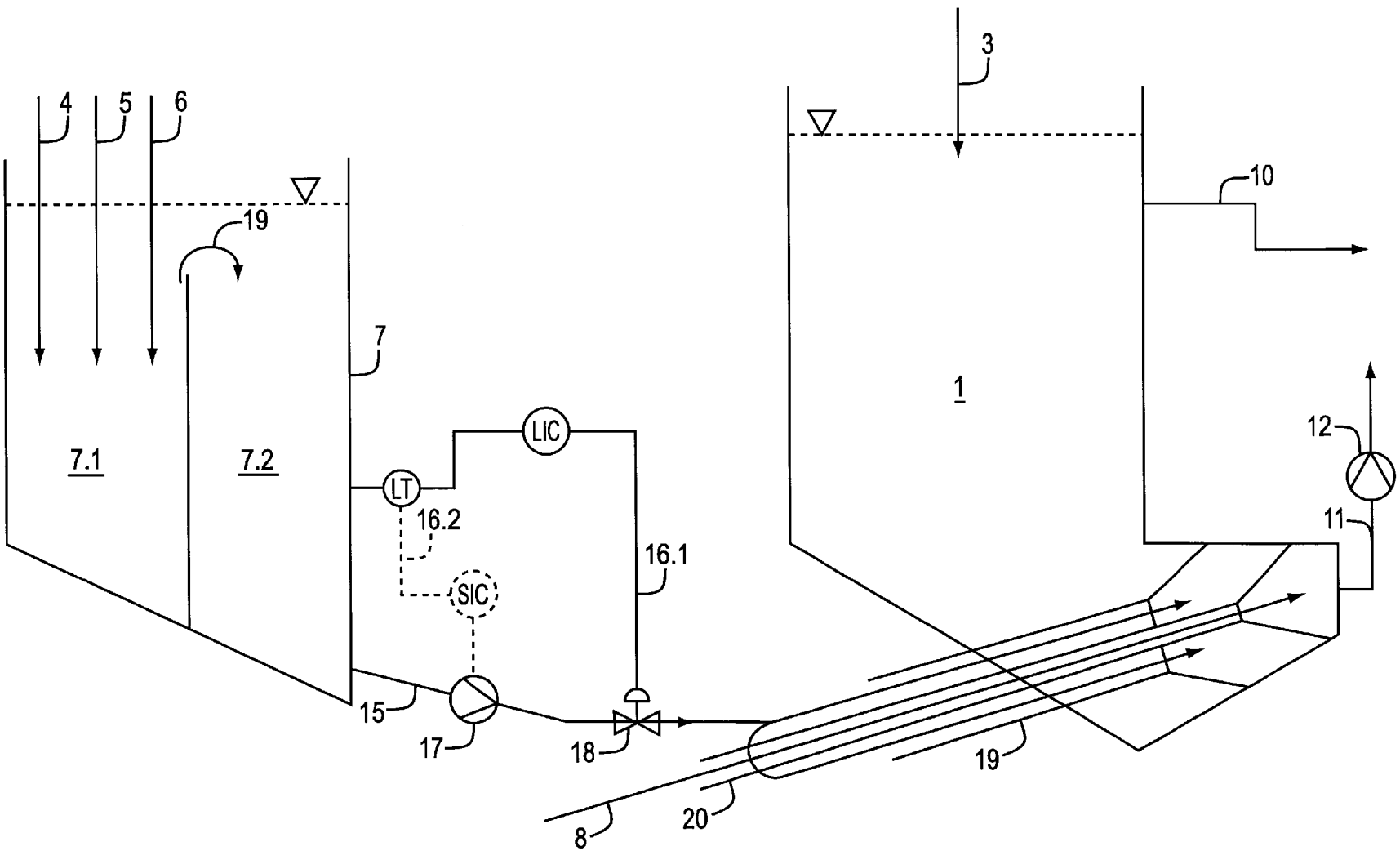
FIG. 4 shows a first embodiment of a mixing and recirculation cycling system according to the invention.

Referring to the drawings wherein like numerals represent like elements, FIG. 4 depicts an embodiment of a mixing cycling system according to the invention. A backwater tank 1 and a mixing tank 7, which are connected to each other by a feed line 19 (also referred to as a "feed pipe"), are provided. The mixing tank 7 has a first chamber 7.1 and a second chamber 7.2. Headbox recirculation 4, accepted stock of a vertical separator stage 5, and accepted stock of a second cleaner stage 6 are added to the first chamber 7.1, and are collectively referred to as "feed lines" 4, 5, 6. In this first chamber 7.1, thorough mixing of the individual streams of stock occurs and after this thorough mixing, overflow 29 into the second chamber 7.2 occurs. From this second chamber 7.2, the very thoroughly mixed suspension (return flow) is drawn, via a discharge line 15, under control of a pressure-increasing device including but not limited to, a pump 17, and fed via the feed line 19 into the backwater tank 1. To aid in mixing the headbox recirculation 4, accepted stock of the vertical separator stage 5, and the accepted stock of the second cleaner stage 6, a mixing element, preferably a mixing propeller 33, may be used.

During normal operation, in the preferred embodiment, the volumetric flow rate of the headbox recirculation 4 fluid is between approximately 4–10% of the volumetric flow rate of the stock suspension inlet 11 fluid. The volumetric flow rate of the vertical separator stage 5 fluid is between approximately 5–25% of the volumetric flow rate of the stock suspension inlet 11 fluid, and the volumetric flow rate of the second cleaner stage 6 fluid is between approximately 5–34% of the volumetric flow rate of the stock suspension inlet 11 fluid.

A valve 18 may also be used to assist in feeding the suspension into the backwater tank. The pumping process also provides an improvement in the thorough mixing of the entire return flow.

A second, smaller pipe 20, in which the fresh stock 8 is fed, is positioned concentrically inside the feed pipe 19. An injection of the stock suspension into the backwater tank 1 at a higher pressure and a higher speed can be carried out because of the adjustable speed of the liquid through the pump 17. Thus, thorough mixing of the backwater with the suspension added and with the fresh stock 8 is achieved. The backwater inlet to the headbox 10 is not affected by the mixing of the more highly concentrated suspensions, since this inlet is installed in the upper region of the backwater tank 1. Thus, only the backwater of low concentration is removed.

The invention creates temporally stable concentration relationships in the backwater inlet 10 used for basis weight control. Thus, improved basis weight profiles as well as stable good paper quality results.

Figure 1:
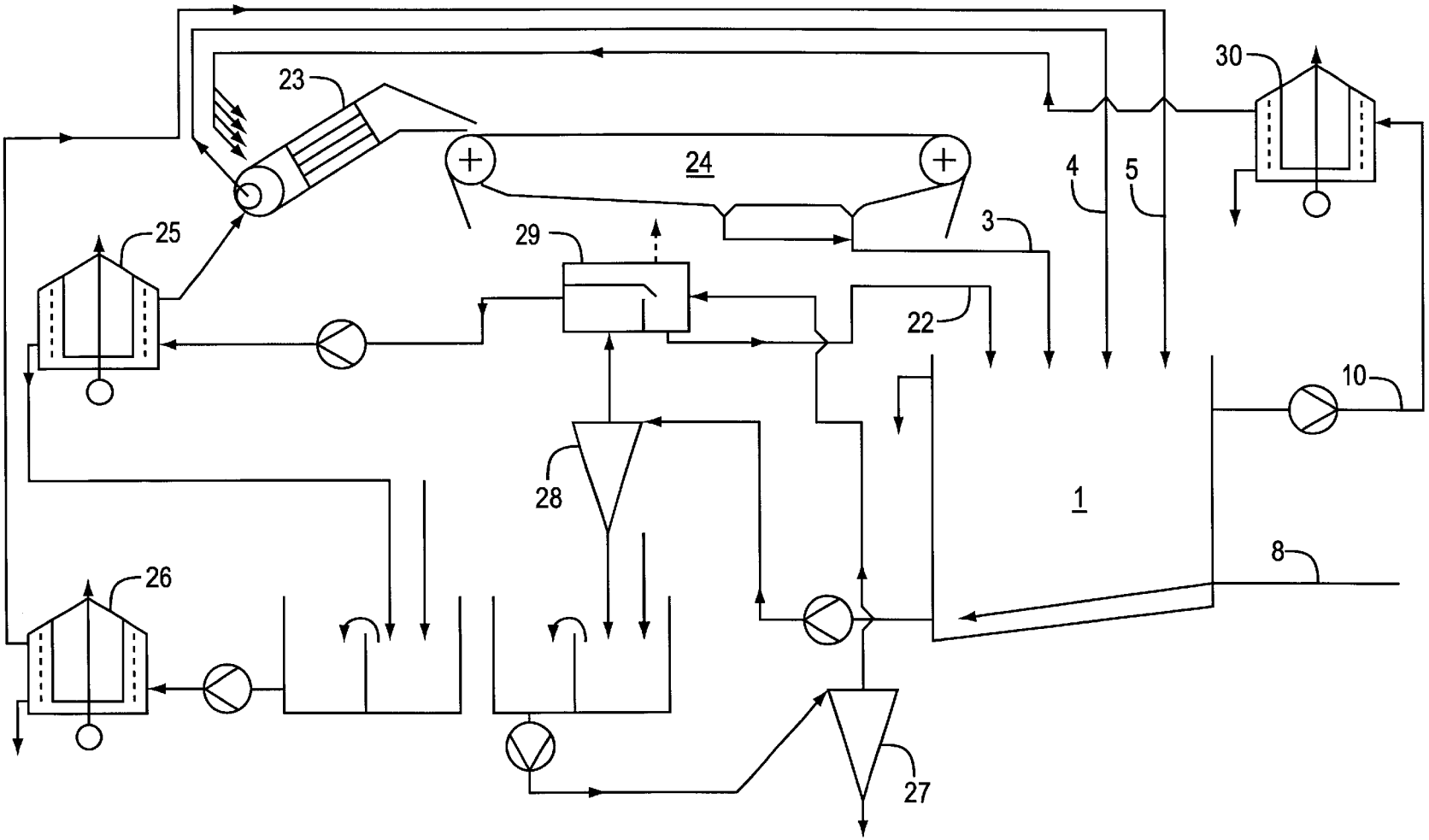
FIG. 1 shows a known mixing cycle having a backwater tank in use with an existing paper or cardboard machine.
Figure 2:
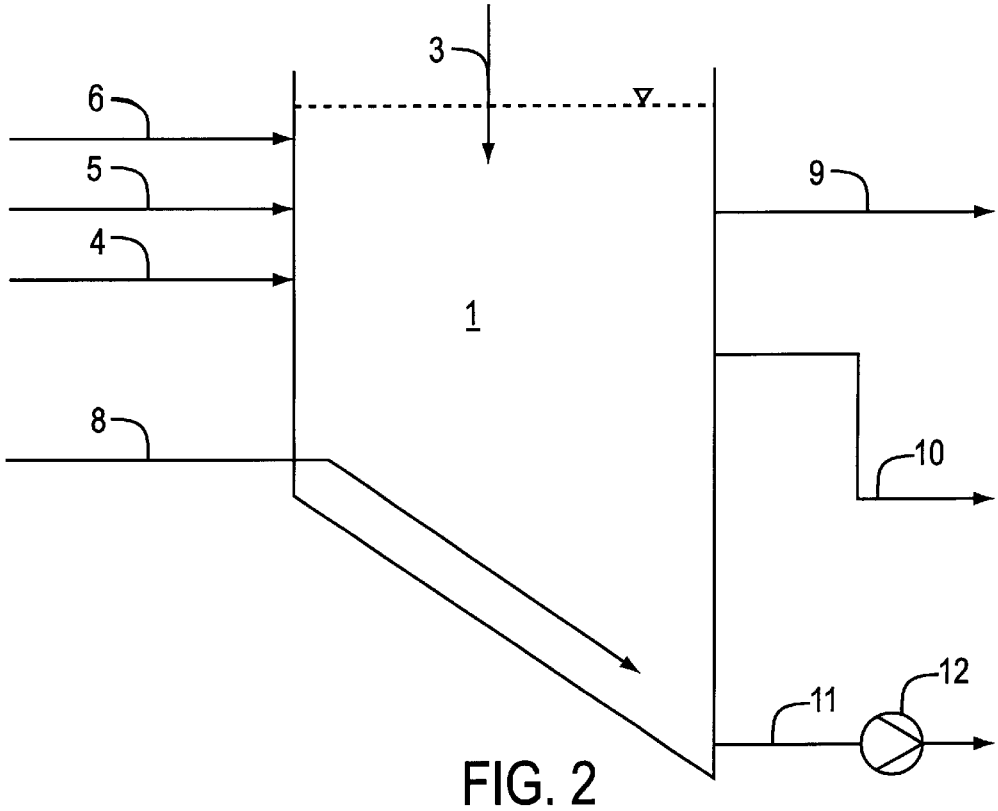
FIG. 2 shows a known backwater tank.
Figure 3:
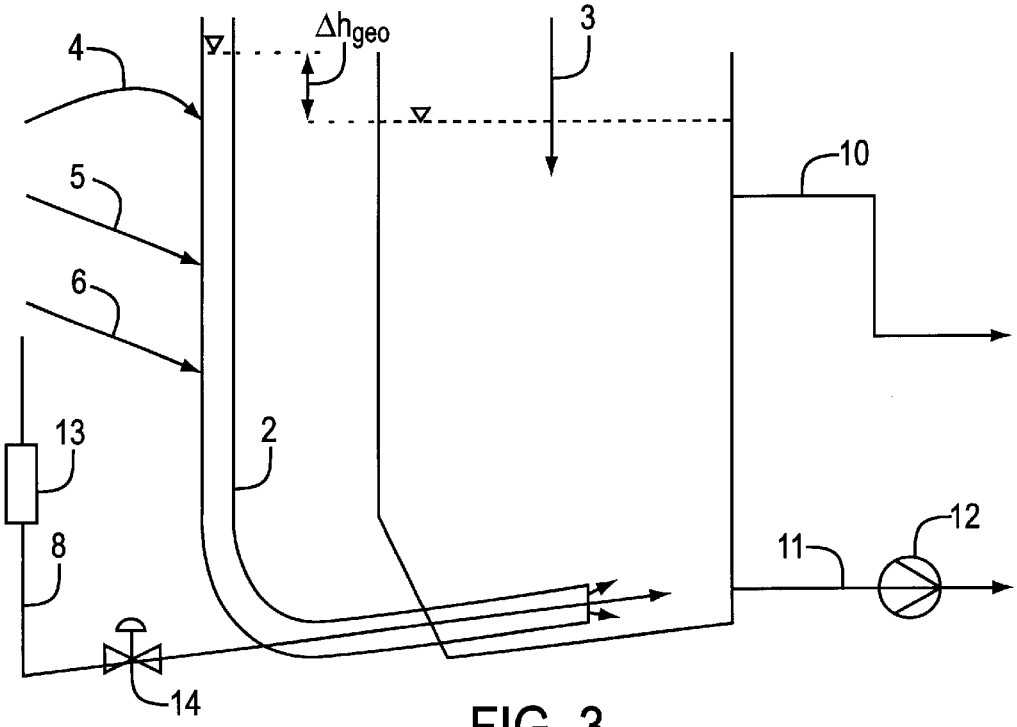
FIG. 3 shows a known mixing cycling system with a backwater tank and standpipe.
Figure 5:
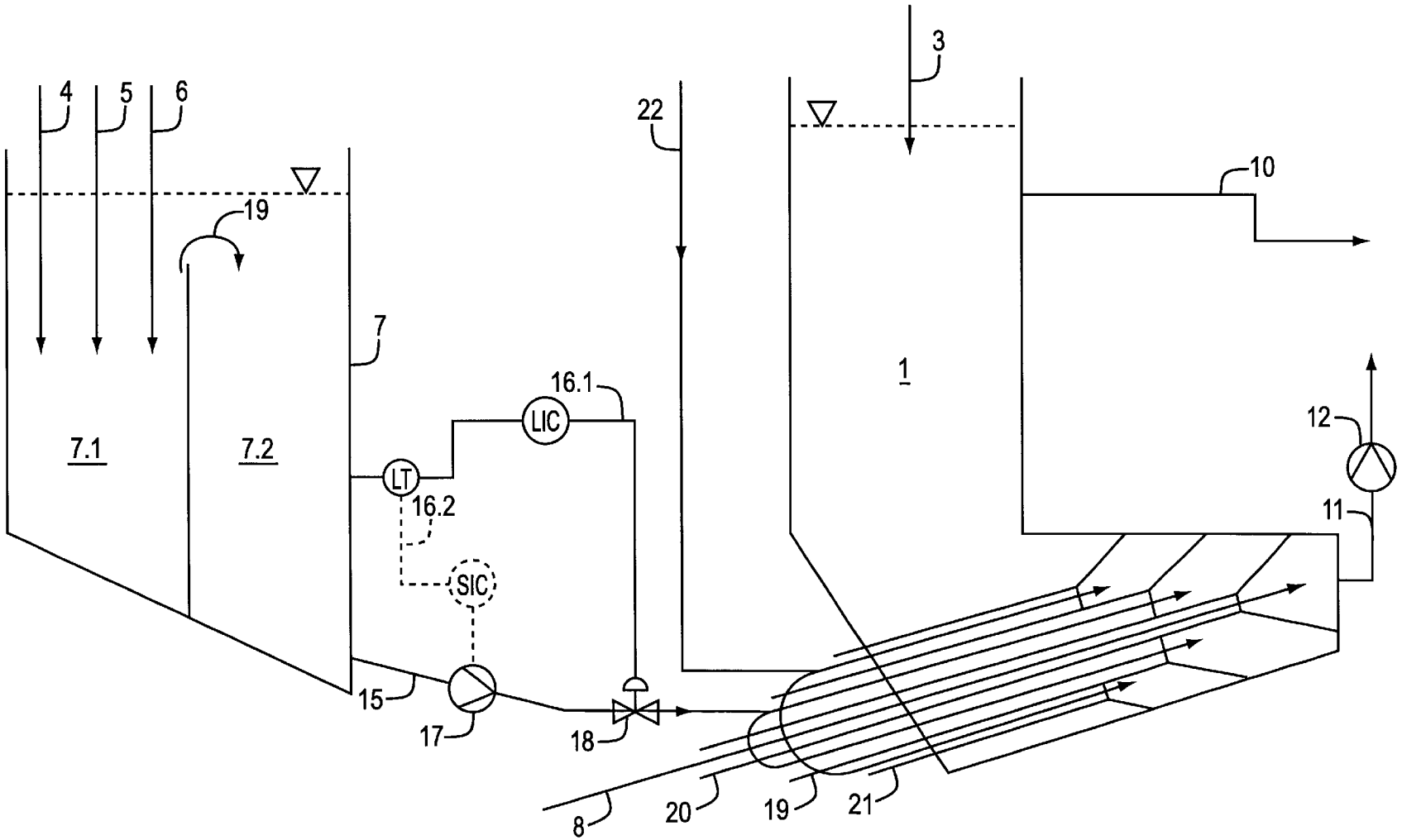
FIG. 5 shows a second embodiment of a mixing and recirculation cycling system according to invention with feeding of the deculator overflow.

FIG. 5 depicts a second embodiment of the mixing and recirculation cycling system according to the invention, having an additional feeding of a deculator loop. The difference between the second embodiment relative to the first embodiment of FIG. 3 is that, in addition to the two concentric feed pipes 19 and 20 for the return flows and the fresh stock of the first embodiment, the second embodiment has a third feed pipe 21 concentrically surrounding the other feed pipes, through which the deculator overflow is fed. Since the volume flow of the deculator overflow is usually the greatest, the concentric arrangement of the three feed pipes from the inside out is preferably in the order of fresh stock, collected return flows, and deculator overflow.

FIGS. 4 and 5 depict first and second alternative control loops 16.1 and 16.2 respectively, to regulate the volume of the mixing tank 7 and may alternatively be used.

The first alternative control loop 16.1 has a level transmitter LT to control the fluid level of the mixing tank 7, and a control valve 18 as a control element for volume flow control. The pump 17 operates with constant speed.

The second alternative control loop 16.2 has a level transmitter LT to control the fluid level of the mixing tank and a speed-controlled pump 17 as a control element for volume flow control.

Other known control mechanisms for level control or volume flow control may be used in alternative embodiments without departing from the spirit and scope of the invention.

For the sake of clarity, the control elements and control loop to control the fresh stock addition around the feed pipe 20 are not depicted in FIGS. 3 and 4.

Through the present invention, optimum thorough mixing of the return flows in the mixing tank 7 are obtained. Additionally, improvement of through mixing by an additional pump 17 is obtained. Moreover, high outlet speeds are guaranteed for the return flows at the end of the feed pipe 19 by the pump 17, whereby in the continuing process, optimum mixing of backwater, return flows, and fresh stock occur in the outlet region of the backwater tank 1 and the deculator overflow (if present).

The present invention may also advantageously be used for modernization of existing old systems, since conversion of the backwater tank is not required.

Additionally, pure backwater is advantageously used in the backwater feed to a dilution-controlled headbox. Thus, negative effects on the basis weight profile control are advantageously avoided.

It is noted flat the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for the mixing and recirculation of stock suspensions, backwater, and return flows in one of a paper or cardboard machine, the machine having at least one head box having a wet section, a backwater tank, a vertical separator stage, a cleaner stage, the method comprising:

feeding backwater from the wet section into a backwater tank;

feeding the return flow into a mixing tank, the return flow comprising at least one of recirculation of the head box, accepted stock of at least one vertical separator stage, and accepted stock of least one cleaner stage;

mixing the return flow in the mixing tank;

injecting the return flow from the mixing tank into a lower region of the backwater tank via a pressure increasing device;

mixing the return flow with the backwater and added fresh stock; and feeding the mixture of return flow, backwater and added fresh stock to the head box via a separation device.

2. The method according to claim 1, wherein the separation device is at least one of a cleaner stage, a deculator and a vertical separator.

3. The method according to claim 1, further comprising:

mixing the return flow in a first chamber of the mixing tank;

passing the return flow into a second chamber by an overflow; and conveying the return flow into a backwater tank.

4. The method according to claim 1, wherein said injecting of the return flow from the mixing tank into a lower region of the backwater tank is facilitated by a pump.

5. The method according to claim 1, further comprising controlling the return flow according to the liquid level in the mixing tank.

6. The method according to claim 1, further comprising feeding, through a concentrically-arranged feed pipe, the fresh stock and the return flow into the backwater tank the fresh stock being fed through a first feed pipe of the concentrically-arranged feed pipe, the return flow being fed through a second feel pipe of the concentrically-arranged feed pipe.

7. The method according to clam 1, further comprising feeding deculator overflow into the lower region of the backwater tank.

8. The method according to claim 7, wherein said feeding of deculator overflow into the backwater tank occurs, alone with the fresh stock and the return flow, though a concentrically-arranged feed pipe, the fresh stock being fed through a first feed pipe of the concentrically-arranged feed pipe, the return flow being fed through a second feed pipe of the concentrically-arranged feed pipe, and the deculator overflow being fed through a third feed pipe of the concentrically-arranged feed pipe.

* * * * *